US011403984B2

(12) United States Patent
Jung et al.

(10) Patent No.: US 11,403,984 B2
(45) Date of Patent: Aug. 2, 2022

(54) METHOD FOR CONTROLLING DISPLAY AND ELECTRONIC DEVICE SUPPORTING THE SAME

(71) Applicant: Samsung Electronics Co., Ltd., Suwon-si (KR)

(72) Inventors: Songhee Jung, Suwon-si (KR); Byungduk Yang, Suwon-si (KR); Minwoo Lee, Suwon-si (KR); Hyunchang Shin, Suwon-si (KR); Yongkoo Her, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/270,687

(22) PCT Filed: Feb. 5, 2021

(86) PCT No.: PCT/KR2021/001583
§ 371 (c)(1),
(2) Date: Feb. 23, 2021

(87) PCT Pub. No.: WO2021/158078
PCT Pub. Date: Aug. 12, 2021

(65) Prior Publication Data

US 2022/0130308 A1 Apr. 28, 2022

(30) Foreign Application Priority Data

Feb. 6, 2020 (KR) ..... 10-2020-0014551
Feb. 10, 2020 (KR) ..... 10-2020-0015954
Feb. 11, 2020 (KR) ..... 10-2020-0016605

(51) Int. Cl.
*G09G 3/20* (2006.01)

(52) U.S. Cl.
CPC ..... *G09G 3/20* (2013.01); *G09G 2310/0267* (2013.01); *G09G 2310/08* (2013.01);
(Continued)

(58) Field of Classification Search
CPC ..... G09G 3/20; G09G 2310/0267; G09G 2310/08; G09G 2320/0247;
(Continued)

(56) References Cited

U.S. PATENT DOCUMENTS 7,468,242 B2 12/2008 Bellomo et al.
8,142,990 B2 3/2012 Bellomo et al.
(Continued)

FOREIGN PATENT DOCUMENTS

KR 10-2008-0040281 A 5/2008
KR 10-2008-0055133 A 6/2008
(Continued)

OTHER PUBLICATIONS

US 8,896,514 B2, 11/2014, Han et al. (withdrawn)
(Continued)

*Primary Examiner* — Andrew Sasinowski
(74) *Attorney, Agent, or Firm* — Jefferson IP Law, LLP

(57) ABSTRACT

An electronic device is provided. The electronic device includes a display panel, a display driver integrated circuit (display driver IC) to drive the display panel, and a processor operatively connected with the display panel and the display driver IC. The display driver IC is configured to set an operating mode including a first mode having a first refresh rate and a first scan time, a second mode having the first refresh rate and a second scan time, and a third mode having a second refresh rate and the second scan time, receive an image data stream from the processor, and output the image data stream in one of the operating mode through the display panel.

20 Claims, 14 Drawing Sheets

(52) U.S. Cl.
CPC ..... *G09G 2320/0247* (2013.01); *G09G 2320/0606* (2013.01); *G09G 2320/0673* (2013.01); *G09G 2330/028* (2013.01)

(58) Field of Classification Search
CPC ... G09G 2320/0606; G09G 2320/0673; G09G 2330/028
See application file for complete search history.

(56) References Cited

U.S. PATENT DOCUMENTS

| | | | | |
|---|---|---|---|---|
| 8,902,207 | B2 | 12/2014 | Ryu et al. | |
| 9,019,188 | B2 | 4/2015 | Han et al. | |
| 9,262,987 | B2 | 2/2016 | Albrecht et al. | |
| 9,299,301 | B2 | 3/2016 | Choi et al. | |
| 9,318,069 | B2 | 4/2016 | Nambi et al. | |
| 9,378,697 | B2 | 6/2016 | Fujioka et al. | |
| 9,501,993 | B2 | 11/2016 | Nambi et al. | |
| 9,524,694 | B2 | 12/2016 | Wang et al. | |
| 9,601,074 | B2 | 3/2017 | Fujioka et al. | |
| 9,620,064 | B2 | 4/2017 | Albrecht et al. | |
| 9,672,792 | B2 | 6/2017 | Choi et al. | |
| 9,697,758 | B2 | 7/2017 | Watanabe et al. | |
| 9,761,201 | B2 | 9/2017 | Tanaka et al. | |
| 9,847,056 | B2 | 12/2017 | Shimizu et al. | |
| 9,865,231 | B2 | 1/2018 | Kim et al. | |
| 9,953,613 | B2 | 4/2018 | Sacchetto et al. | |
| 9,984,664 | B2 | 5/2018 | Glen et al. | |
| 10,019,968 | B2 | 7/2018 | Bi et al. | |
| 10,043,492 | B2 * | 8/2018 | Woo | G09G 5/393 |
| 10,049,642 | B2 | 8/2018 | Ansari | |
| 10,056,050 | B2 | 8/2018 | Nambi et al. | |
| 10,096,080 | B2 | 10/2018 | Kwa et al. | |
| 10,210,845 | B2 | 2/2019 | Glen et al. | |
| 10,600,379 | B2 | 3/2020 | Nambi et al. | |
| 2007/0183974 | A1 | 8/2007 | Pearlman | |
| 2008/0106542 | A1 | 5/2008 | Park et al. | |
| 2011/0057917 | A1 | 3/2011 | Ryu et al. | |
| 2012/0201793 | A1 | 8/2012 | Bellomo et al. | |
| 2014/0198093 | A1 | 7/2014 | Nambi et al. | |
| 2014/0267370 | A1 | 9/2014 | Albrecht et al. | |
| 2014/0267448 | A1 | 9/2014 | Albrecht et al. | |
| 2014/0368492 | A1 | 12/2014 | Fujioka et al. | |
| 2015/0130823 | A1 | 5/2015 | Kim et al. | |
| 2015/0248873 | A1 | 9/2015 | Tanaka et al. | |
| 2015/0287352 | A1 | 10/2015 | Watanabe et al. | |
| 2015/0379665 | A1 | 12/2015 | Kwa et al. | |
| 2016/0093248 | A1 | 3/2016 | Shimizu et al. | |
| 2016/0125785 | A1 | 5/2016 | Wang et al. | |
| 2016/0267870 | A1 | 9/2016 | Fujioka et al. | |
| 2016/0275916 | A1 | 9/2016 | Glen et al. | |
| 2017/0193971 | A1 | 7/2017 | Bi et al. | |
| 2018/0018910 | A1 * | 1/2018 | Jang | G09G 3/2092 |
| 2018/0053463 | A1 * | 2/2018 | Kong | G09G 3/20 |
| 2018/0174551 | A1 | 6/2018 | Ansari | |
| 2018/0247616 | A1 | 8/2018 | Glen et al. | |
| 2018/0301121 | A1 * | 10/2018 | Kim | H04N 21/4312 |
| 2018/0350313 | A1 | 12/2018 | Nambi et al. | |
| 2019/0057643 | A1 * | 2/2019 | Bae | G09G 3/3233 |
| 2019/0371264 | A1 | 12/2019 | Koo et al. | |
| 2020/0043432 | A1 * | 2/2020 | Choi | G09G 3/20 |
| 2021/0104206 | A1 | 4/2021 | Koo et al. | |
| 2021/0183290 | A1 | 6/2021 | Sato et al. | |
| 2021/0201738 | A1 | 7/2021 | Song et al. | |

FOREIGN PATENT DOCUMENTS

| | | | |
|---|---|---|---|
| KR | 10-2011-0026152 | A | 3/2011 |
| KR | 10-1076445 | A | 10/2011 |
| KR | 10-2011-0136775 | A | 12/2011 |
| KR | 10-2015-0055503 | A | 5/2015 |
| KR | 10-2015-0068475 | A | 6/2015 |
| KR | 10-2016-0053377 | A | 5/2016 |
| KR | 10-2017-0098314 | A | 8/2017 |
| KR | 10-1774127 | B1 | 9/2017 |
| KR | 10-1954934 | B1 | 3/2019 |
| KR | 10-1992879 | B1 | 6/2019 |
| KR | 10-2020-0010689 | A | 1/2020 |

OTHER PUBLICATIONS

International Search Report dated May 28, 2021, issued in an International Application No. PCT/KR2021/001583.
International Search Report dated May 28, 2021, issued an International Application No. PCT/KR2021/001574.
International Search Report dated Jun. 4, 2021, issued an International Application No. PCT/KR2021/001130.
U.S. Office Action dated Feb. 18, 2022, issued by the U.S. Patent and Trademark Office U.S. Appl. No. 17/267,384.

* cited by examiner

METHOD FOR CONTROLLING DISPLAY AND ELECTRONIC DEVICE SUPPORTING THE SAME

TECHNICAL FIELD

The disclosure relates to a method for controlling a display and an electronic device supporting the same.

BACKGROUND ART

An electronic device, such as a smartphone, or a tablet personal computer (PC), may include a display. The electronic device may display various types of content, such as a text, an image, or an icon, through the display. The electronic device may drive the display at various refresh rates (e.g., 60 Hz or 120 Hz). When the refresh rate is increased, a time taken to display one frame may be shortened, and a more natural image may be provided to a user.

DISCLOSURE

Technical Problem

When a refresh rate for driving a display panel is changed in a display driver integrated circuit (IC) of an electronic device, a time taken to charge a data voltage and/or a time taken to discharge the data voltage may be varied. Accordingly, an abnormal image output (e.g., the flickering of a screen) may be caused.

Technical Solution

An aspect of the disclosure is to provide an electronic device capable of controlling the brightness and/or a color difference of a screen, when the refresh rate for driving the display panel is changed.

In accordance with an aspect of the disclosure, an electronic device is provided. The electronic device includes a display panel, a display driver integrated circuit (display driver IC) to drive the digital pen, and a processor operatively connected with the display panel and the display driver IC. The display driver IC may be configured to set an operating mode including a first operating mode having a first refresh rate and a first scan time, a second operating mode having the first refresh rate and a second scan time, and a third operating mode having a second refresh rate and the second scan time, receive an image data stream from the processor, and output the image data stream in one of the operating mode through the display panel.

In accordance with another aspect of the disclosure, a method for displaying a screen, which is performed in an electronic device including a display panel, is provided. The method includes setting an operating mode including a first operating mode having a first refresh rate and a first scan time, a second operating mode having the first refresh rate and a second scan time, and a third operating mode having a second refresh rate and the second scan time, in a display driver IC to drive the display panel, receiving, in the driving driver IC, an image data stream from a processor of the electronic device, and outputting the image data stream through the display panel in one of the operating mode.

In accordance with another aspect of the disclosure, a storage medium is provided. The storage medium has instructions, and the instructions, when executed by at least one processor, may be configured to cause the at least one processor to perform at least one operation. The at least one operation may include setting an operating mode including a first operating mode having a first refresh rate and a first scan time, a second operating mode having the first refresh rate and a second scan time, and a third operating mode having a second refresh rate and the second scan time, displaying an image by using a display panel operatively connected with the processor, receiving a user input onto the display panel, identifying the operating mode corresponding to the received user input, and displaying another image associated with the image, based on the identified operating mode.

Advantageous Effects

According to various embodiments of the disclosure, the electronic device may provide a mode of controlling the brightness and/or the color difference of the screen, when the refresh rate for driving the display panel is changed.

According to various embodiments of the disclosure, the electronic device may maintain the scan time taken to display one image frame when the refresh rate is changed, thereby reducing the brightness difference which may be caused when the screen is switched.

According to various embodiments of the disclosure, the electronic device may display the screen having no abnormal image output (e.g., flickering) by controlling the display panel based on the refresh rate and/or the scan time.

MODE FOR INVENTION

Figure 1:
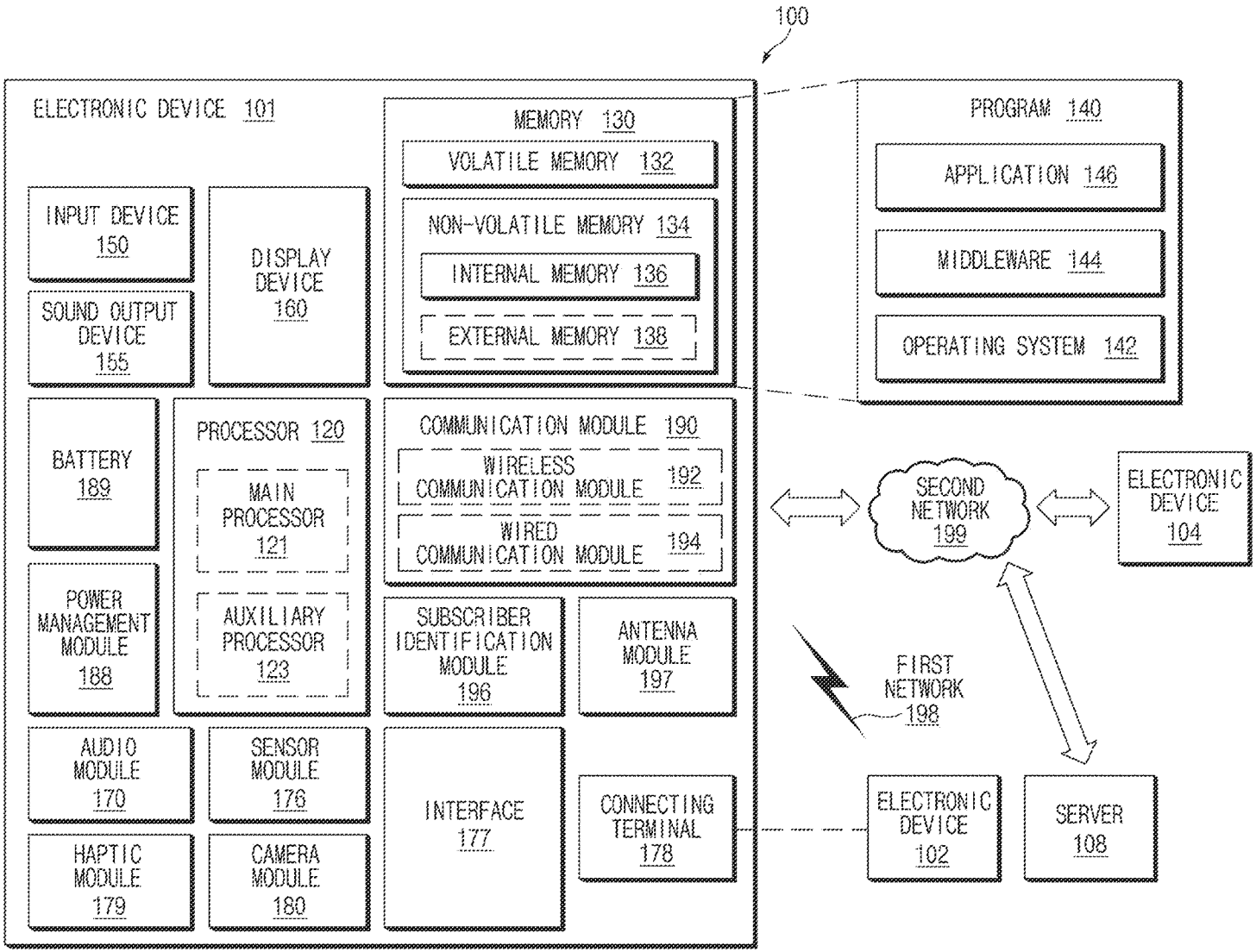
FIG. 1 illustrates an electronic device under a network environment, according to various embodiments.

Hereinafter, various embodiments of the disclosure may be described with reference to accompanying drawings. Accordingly, those of ordinary skill in the art will recognize that modification, equivalent, and/or alternative on the various embodiments described herein can be variously made without departing from the scope and spirit of the disclosure.

With regard to description of drawings, similar components may be marked by similar reference numerals.

FIG. 1 is a block diagram of an electronic device in a network environment according to various embodiments.

Referring to FIG. 1, an electronic device 101 may communicate with an electronic device 102 through a first network 198 (e.g., a short-range wireless communication network) or may communicate with an electronic device 104 or a server 103 through a second network 199 (e.g., a long-distance wireless communication network) in a network environment 100. According to an embodiment, the electronic device 101 may communicate with the electronic device 104 through the server 103. According to an embodiment, the electronic device 101 may include a processor 120, a memory 130, an input device 150, a sound output device 155, a display device 160, an audio module 170, a sensor module 176, an interface 177, a haptic module 179, a camera module 180, a power management module 188, a battery 189, a communication module 190, a subscriber identification module 196, or an antenna module 197. According to some embodiments, at least one (e.g., the display device 160 or the camera module 180) among components of the electronic device 101 may be omitted or one or more other components may be added to the electronic device 101. According to some embodiments, some of the above components may be implemented with one integrated circuit. For example, the sensor module 176 (e.g., a fingerprint sensor, an iris sensor, or an illuminance sensor) may be embedded in the display device 160 (e.g., a display).

The processor 120 may execute, for example, software (e.g., a program 140) to control at least one of other components (e.g., a hardware or software component) of the electronic device 101 connected to the processor 120 and may process or compute a variety of data. According to an embodiment, as a part of data processing or operation, the processor 120 may load a command set or data, which is received from other components (e.g., the sensor module 176 or the communication module 190), into a volatile memory 132, may process the command or data loaded into the volatile memory 132, and may store result data into a nonvolatile memory 134. According to an embodiment, the processor 120 may include a main processor 121 (e.g., a central processing unit or an application processor) and an auxiliary processor 123 (e.g., a graphic processing device, an image signal processor, a sensor hub processor, or a communication processor), which operates independently from the main processor 121 or with the main processor 121. Additionally or alternatively, the auxiliary processor 123 may use less power than the main processor 121, or is specified to a designated function. The auxiliary processor 123 may be implemented separately from the main processor 121 or as a part thereof.

The auxiliary processor 123 may control, for example, at least some of functions or states associated with at least one component (e.g., the display device 160, the sensor module 176, or the communication module 190) among the components of the electronic device 101 instead of the main processor 121 while the main processor 121 is in an inactive (e.g., sleep) state or together with the main processor 121 while the main processor 121 is in an active (e.g., an application execution) state. According to an embodiment, the auxiliary processor 123 (e.g., the image signal processor or the communication processor) may be implemented as a part of another component (e.g., the camera module 180 or the communication module 190) that is functionally related to the auxiliary processor 123.

The memory 130 may store a variety of data used by at least one component (e.g., the processor 120 or the sensor module 176) of the electronic device 101. For example, data may include software (e.g., the program 140) and input data or output data with respect to commands associated with the software. The memory 130 may include the volatile memory 132 or the nonvolatile memory 134.

The program 140 may be stored in the memory 130 as software and may include, for example, a kernel 142, a middleware 144, or an application 146.

The input device 150 may receive a command or data, which is used for a component (e.g., the processor 120) of the electronic device 101, from an outside (e.g., a user) of the electronic device 101. The input device 150 may include, for example, a microphone, a mouse, a keyboard, or a digital pen (e.g., a stylus pen).

The sound output device 155 may output a sound signal to the outside of the electronic device 101. The sound output device 155 may include, for example, a speaker or a receiver. The speaker may be used for general purposes, such as multimedia play or recordings play, and the receiver may be used for receiving calls. According to an embodiment, the receiver and the speaker may be either integrally or separately implemented.

The display device 160 may visually provide information to the outside (e.g., the user) of the electronic device 101. For example, the display device 160 may include a display, a hologram device, or a projector and a control circuit for controlling a corresponding device. According to an embodiment, the display device 160 may include a touch circuitry configured to sense the touch or a sensor circuit (e.g., a pressure sensor) for measuring an intensity of pressure on the touch.

The audio module 170 may convert a sound and an electrical signal in dual directions. According to an embodiment, the audio module 170 may obtain the sound through the input device 150 or may output the sound through the sound output device 155 or an external electronic device (e.g., the electronic device 102 (e.g., a speaker or a headphone)) directly or wirelessly connected to the electronic device 101.

The sensor module 176 may generate an electrical signal or a data value corresponding to an operating state (e.g., power or temperature) inside or an environmental state (e.g., a user state) outside the electronic device 101. According to an embodiment, the sensor module 176 may include, for example, a gesture sensor, a gyro sensor, a barometric pressure sensor, a magnetic sensor, an acceleration sensor, a grip sensor, a proximity sensor, a color sensor, an infrared sensor, a biometric sensor, a temperature sensor, a humidity sensor, or an illuminance sensor.

The interface 177 may support one or more designated protocols to allow the electronic device 101 to connect directly or wirelessly to the external electronic device (e.g., the electronic device 102). According to an embodiment, the interface 177 may include, for example, a high-definition multimedia interface (HDMI), a universal serial bus (USB) interface, a secure digital (SD) card interface, or an audio interface.

A connecting terminal 178 may include a connector that physically connects the electronic device 101 to the external electronic device (e.g., the electronic device 102). According to an embodiment, the connecting terminal 178 may include, for example, an HDMI connector, a USB connector, an SD card connector, or an audio connector (e.g., a headphone connector).

The haptic module 179 may convert an electrical signal to a mechanical stimulation (e.g., vibration or movement) or an electrical stimulation perceived by the user through tactile or kinesthetic sensations. According to an embodiment, the haptic module 179 may include, for example, a motor, a piezoelectric element, or an electric stimulator.

The camera module 180 may shoot a still image or a video image. According to an embodiment, the camera module 180 may include, for example, at least one or more lenses, image sensors, image signal processors, or flashes.

The power management module 188 may manage power supplied to the electronic device 101. According to an embodiment, the power management module 188 may be implemented as at least a part of a power management integrated circuit (PMIC).

The battery 189 may supply power to at least one component of the electronic device 101. According to an embodiment, the battery 189 may include, for example, a non-rechargeable (primary) battery, a rechargeable (secondary) battery, or a fuel cell.

The communication module 190 may establish a direct (e.g., wired) or wireless communication channel between the electronic device 101 and the external electronic device (e.g., the electronic device 102, the electronic device 104, or the server 103) and support communication execution through the established communication channel. The communication module 190 may include at least one communication processor operating independently from the processor 120 (e.g., the application processor) and supporting the direct (e.g., wired) communication or the wireless communication. According to an embodiment, the communication module 190 may include a wireless communication module (or a wireless communication circuit) 192 (e.g., a cellular communication module, a short-range wireless communication module, or a global navigation satellite system (GNSS) communication module) or a wired communication module 194 (e.g., a local area network (LAN) communication module or a power line communication module). The corresponding communication module among the above communication modules may communicate with the external electronic device through the first network 198 (e.g., the short-range communication network such as a Bluetooth, a Wi-Fi direct, or an infrared data association (IrDA)) or the second network 199 (e.g., the long-distance wireless communication network such as a cellular network, an internet, or a computer network (e.g., LAN or wide area network (WAN))). The above-mentioned various communication modules may be implemented into one component (e.g., a single chip) or into separate components (e.g., chips), respectively. The wireless communication module 192 may identify and authenticate the electronic device 101 using user information (e.g., international mobile subscriber identity (IMSI)) stored in the subscriber identification module 196 in the communication network, such as the first network 198 or the second network 199.

The antenna module 197 may transmit or receive a signal or power to or from the outside (e.g., an external electronic device). According to an embodiment, the antenna module may include one antenna including a radiator made of a conductor or conductive pattern formed on a substrate (e.g., a printed circuit board (PCB)). According to an embodiment, the antenna module 197 may include a plurality of antennas. In this case, for example, the communication module 190 may select one antenna suitable for a communication method used in the communication network such as the first network 198 or the second network 199 from the plurality of antennas. The signal or power may be transmitted or received between the communication module 190 and the external electronic device through the selected one antenna. According to some embodiments, in addition to the radiator, other parts (e.g., a radio-frequency integrated circuit (RFIC)) may be further formed as a portion of the antenna module 197.

At least some components among the components may be connected to each other through a communication method (e.g., a bus, a general purpose input and output (GPIO), a serial peripheral interface (SPI), or a mobile industry processor interface (MIPI)) used between peripheral devices to exchange signals (e.g., a command or data) with each other.

According to an embodiment, the command or data may be transmitted or received between the electronic device 101 and the external electronic device 104 through the server 108 connected to the second network 199. Each of the electronic devices 102 and 104 may be the same or different types as or from the electronic device 101. According to an embodiment, all or some of the operations performed by the electronic device 101 may be performed by one or more external electronic devices among the external electronic devices 102, 104, or 108. For example, when the electronic device 101 performs some functions or services automatically or by request from a user or another device, the electronic device 101 may request one or more external electronic devices to perform at least some of the functions related to the functions or services, in addition to or instead of performing the functions or services by itself. The one or more external electronic devices receiving the request may carry out at least a part of the requested function or service or the additional function or service associated with the request and transmit the execution result to the electronic device 101. The electronic device 101 may provide the result as is or after additional processing as at least a part of the response to the request. To this end, for example, a cloud computing, distributed computing, or client-server computing technology may be used.

Figure 2:
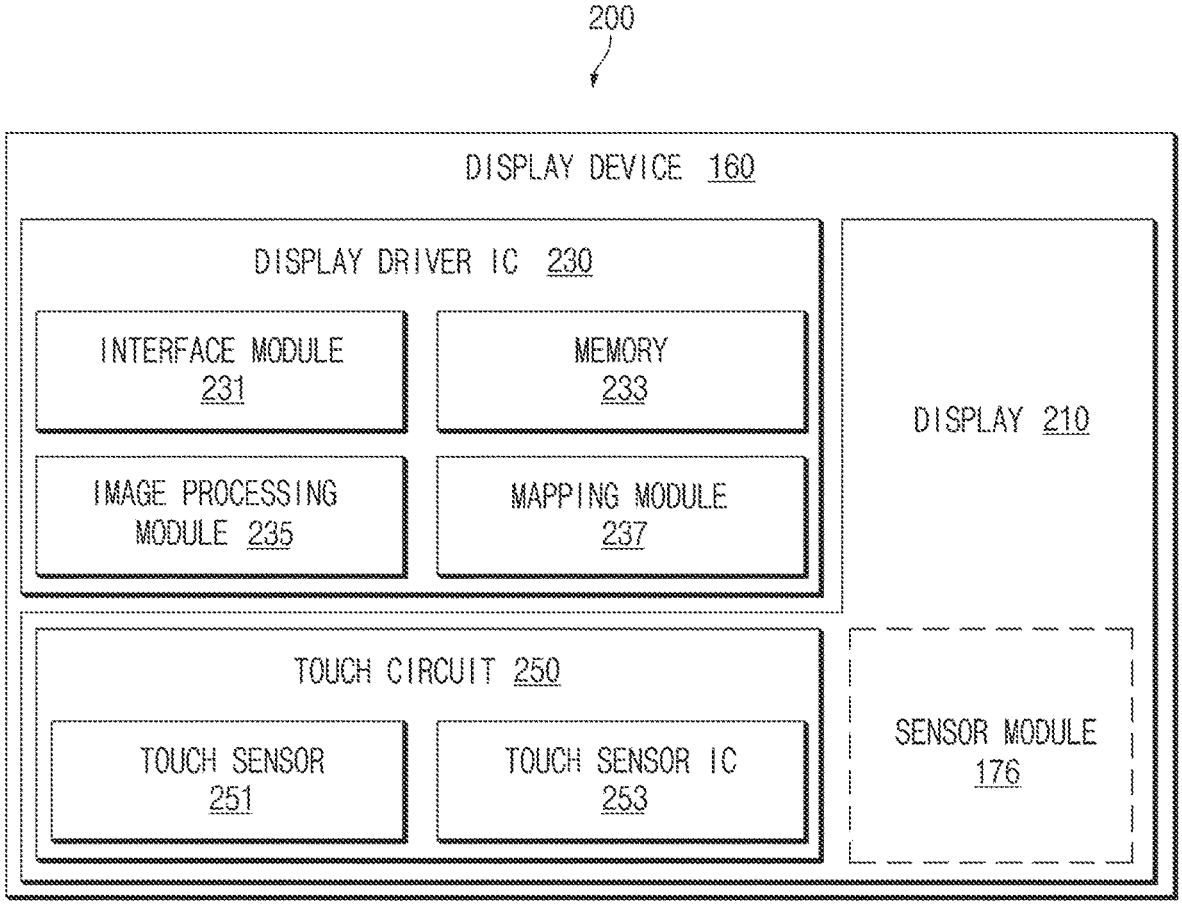
FIG. 2 is a block diagram of a display device, according to various embodiments.

FIG. 2 is a block diagram of a display device, according to various embodiments. Referring to FIG. 2, the display device 160 of device 200 may include the display 210 and a display driver integrated circuit (DDI) 230 to control the display 210. The DDI 230 may include an interface module 231, a memory 233 (e.g., a buffer memory), an image processing module 235, or a mapping module 237. For example, the DDI 230 may receive image information including image data or an image control signal, which corresponds to a command for controlling the image data, from another component of the electronic device (e.g., the electronic device 101 of FIG. 1) through the interface module 231. For example, according to an embodiment, the image information may be received from the processor 120 (e.g., the main processor 121)(e.g., an application processor) or the auxiliary processor 123 (e.g., a graphic processing device) operated independently from the function of the main processor 121. The DDI 230 may communicate with a touch circuit 250 or the sensor module 176 through the interface module 231. The DDI 230 may store at least some of the received image information in the memory 233, for example, in units of a frame. The image processing module 235 may perform pre-treatment or post-treatment (e.g., adjusting a resolution, a brightness, or a size), with respect to, for example, at least some of the image data, based at least on the characteristic of the image data or the characteristic of the display 210. The mapping module 237 may generate a voltage value or a current value corresponding to the image data subject to the pre-treatment or the post-treatment through the image processing module 235.

According to an embodiment, the voltage value and the current value may be generated based at least partially on attributes (e.g., an array (a red, green, and blue (RGB) stripe or pentile structure) of pixels or the size of each sub-pixel) of the display 210. At least some pixels of the display 210 may be driven based at least partially on, for example, the voltage value or the current value, such that visual information (e.g., a text, an image, or an icon) corresponding to the image data is displayed through the display 210.

According to an embodiment, the display device 160 may further include the touch circuit 250. The touch circuit 250 may include a touch sensor 251 and a touch sensor IC 253 for controlling the touch sensor 251. For example, the touch sensor IC 253 may control the touch sensor 251 to sense a touch input or a hovering input to a specified position of the display 210. For example, the touch sensor IC 253 may sense the touch input or the hovering input by measuring the variation of a signal (e.g., a voltage, a light quantity, a resistance, or a quantity of electric charge) for the specified position of the display 210. The touch sensor IC 253 may provide, to the processor 120, information (e.g., a position, an area, pressure, or a time) on the sensed touch input or hovering input. According to an embodiment, at least a portion (e.g., the touch sensor IC 253) of the touch circuit 250 may be included in a portion of the display driver IC 230 or a portion of the display 210, or a portion of another component (e.g., the auxiliary processor 123) disposed outside the display device 160.

According to an embodiment, the display device 160 may further include at least one sensor (e.g., a fingerprint sensor, an iris sensor, a pressure sensor, or an illuminance sensor) of the sensor module 176 or a control circuit for the at least one sensor. In this case, the at least one sensor or the control circuit for the at least one sensor may be embedded in a portion (e.g., the display 210 or the DDI 230) of the display device 160 or a portion of the touch circuit 250. For example, when the sensor module 176 embedded in the display device 160 includes a biometric sensor (e.g., a fingerprint sensor), the biometric sensor may obtain biometric information (e.g., a fingerprint image) associated with a touch input through a partial area of the display 210. For another example, when the sensor module 176 embedded in the display device 160 includes a pressure sensor, the pressure sensor may obtain input information associated with a touch input through a partial area or the entire area of the display 210. According to an embodiment, the touch sensor 251 or the sensor module 176 may be disposed between pixels provided in a pixel layer of the display 210 or disposed on or under the pixel layer of the display 210.

Figure 3:
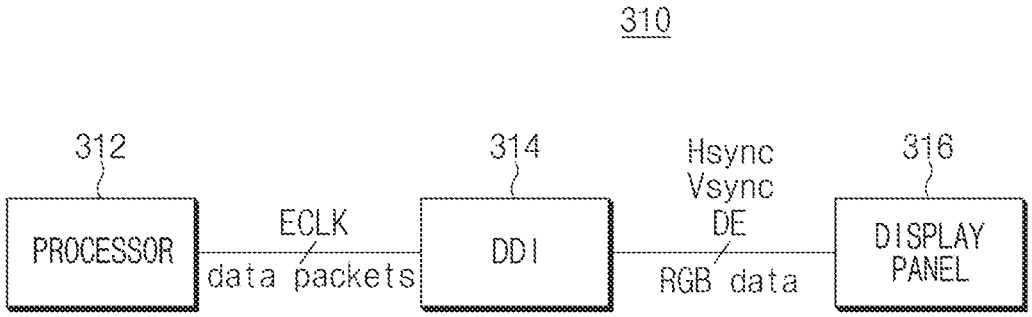
FIG. 3 is a block diagram of an electronic device, according to various embodiments.

FIG. 3 is a block diagram of an electronic device, according to various embodiments.

Referring to FIG. 3, an electronic device (e.g., the electronic device 101 in FIG. 1) 310 may be a processor (e.g., the processor 120 in FIG. 1, an application processor (AP), a communication processor (CP), or a module including a sensor hub or a microcontroller unit (MCU)) 312, a display driver integrated circuit (hereinafter referred to as a "DDI") 314, and a display panel 316 (e.g., the display device 160 of FIG. 1).

According to various embodiments, the processor 312 may transmit data packets including image data to the DDI 314, in response to a clock (e.g., ECLK) of the electronic device 310. In this case, the data packet may include image data (e.g., RGB data), a horizontal sync signal Hsync, a vertical sync signal Vsync, and/or a data enable signal DE.

According to various embodiments, the DDI 314 may receive the data packets from the processor 312 through an interface and may output the horizontal sync signal Hsync, the vertical sync signal Vsync, the data enable signal DE, the image data (e.g., RGB data), and/or a clock (e.g., PCLK). For example, the clock (PCLK) may be the clock (e.g., ECLK) input from the processor 312.

According to an embodiment, the processor 312 and/or the DDI 314 may control various interfaces. For example, the interface may include a mobile industry processor interface (MIPI), a mobile display digital interface (MDDI), a serial peripheral interface (SPI), an inter-integrated circuit (I2C), or a compact display port (CDP).

According to an embodiment, the DDI 314 may include a graphic memory (hereinafter "GRAM"). According to an embodiment, the DDI 314 may reduce current consumption and a load of the processor 312 using the GRAM. The GRAM may write image data input from the processor 312 and may output the written data through a scan operation. According to an embodiment, the GRAM may be implemented as a dual port dynamic random-access memory (DRAM).

According to various embodiments, the display panel 316 may display the image data (e.g., RGB data) in units of a frame under the control of the DDI 314. For example, the display panel 316 may be any one of an organic light emitting diode (OLED) panel, a liquid crystal display panel (LCD), a plasma display panel (PDP), an electrophoretic display panel, and/or an electrowetting display panel. According to an embodiment, the display panel 316 may be an active matrix organic light emitting diode (AMOLED) display manufactured through a low temperature poly silicon (LTPS) process.

Figure 4:
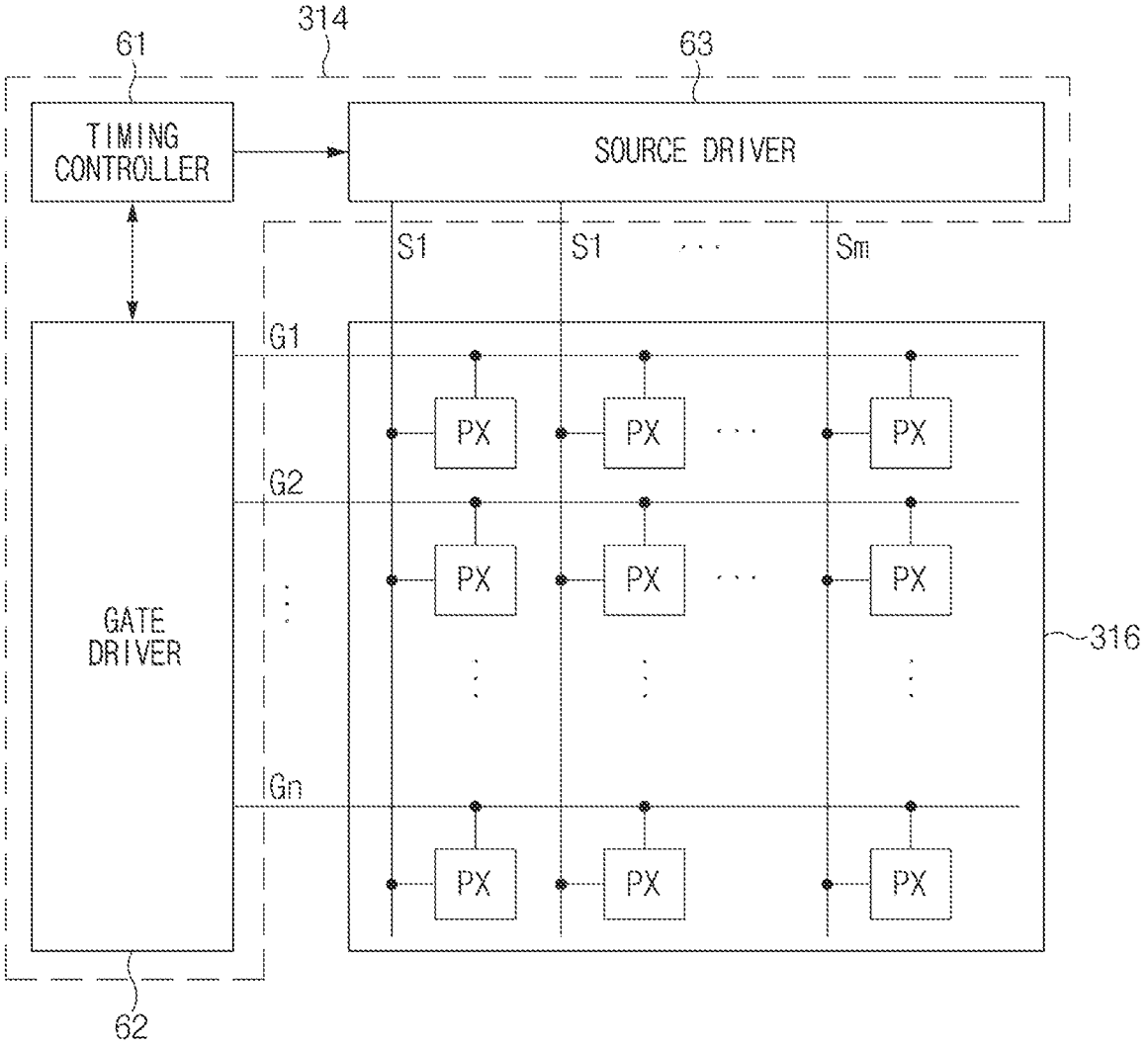
FIG. 4 is a block diagram illustrating a configuration of a DDI and a display panel, according to various embodiments.

According to an embodiment, for example, the display panel 316 may be provided in the form of a matrix in which gate lines (e.g., gate lines G1-Gn in FIG. 4) cross source lines (e.g., source lines S1-Sm in FIG. 4). For example, a gate signal may be supplied to gate lines, and a signal corresponding to image data (e.g., RGB data) may be supplied to the source lines. The signal corresponding to the image data (e.g., the RGB data) may be supplied to a source driver (e.g., a source driver 63 in FIG. 4) under the control of a timing controller (e.g., a timing controller 61 in FIG. 4) inside the DDI 314.

FIG. 4 is a block diagram illustrating a configuration of a DDI and a display panel according to various embodiments. FIG. 4 is provided for the illustrative purpose, and the disclosure is not limited thereto.

Referring to FIG. 4, the DDI 314 may output image data (e.g., RGB data; an image data stream) on the display panel 316 at a specified refresh rate (or a frame rate, a display driving speed).

According to various embodiments, the DDI 314 may include the timing controller 61, a gate driver 62, and the source driver 63. The display panel 316 may include a plurality of pixels PX disposed along a plurality of gate lines G1-Gn and a plurality of source lines S1-Sm.

According to various embodiments, the timing controller 61 may provide a clock signal for the operation of the gate driver 62 and/or the source driver 63. The gate driver 62 may drive a switching device (not illustrated) by applying a voltage (e.g., VGH or VGL) to the plurality of gate lines G1-Gn. The source driver 63 may convert image data (e.g., RGB data) transmitted in the form of a digital value into an analog value to charge pixels with power.

According to an embodiment, the DDI 314 may display an image in units of a frame. The gate driver 62 may sequentially scan the plurality of gate lines G1-Gn, during a time (hereinafter, scan time) necessary for displaying one frame. During the time that the gate driver 62 scans the plurality of gate lines G1-Gn, the source driver 63 may input a signal (hereinafter, data signal) corresponding to image data (e.g., RGB data) to the pixels PX.

Figure 5:
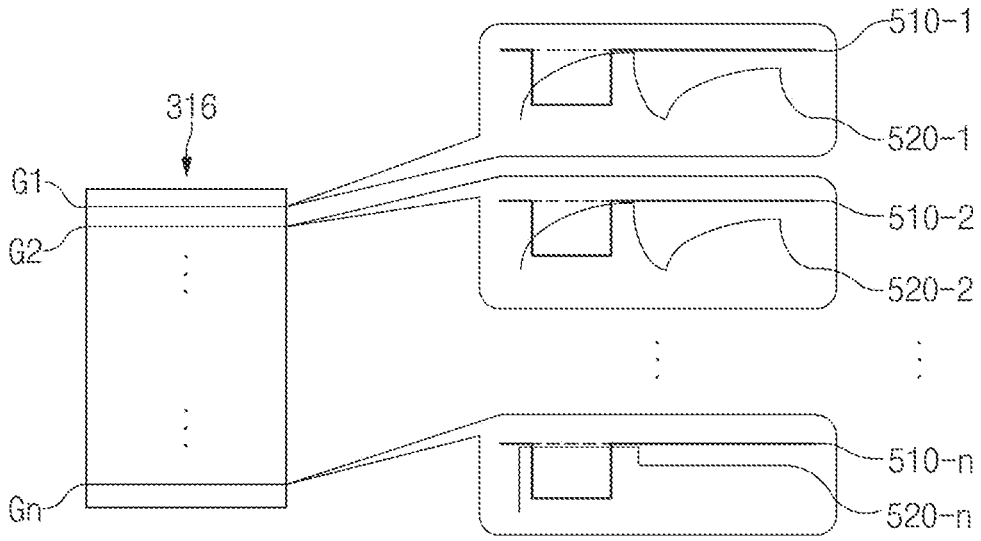
FIG. 5 illustrates driving of a display panel, according to various embodiments.

FIG. 5 illustrates the driving of a display panel, according to various embodiments;

Referring to FIG. 5, a DDI (e.g., the DDI 314 in FIG. 3) may drive the display panel 316

According to various embodiments, the DDI 314 may sequentially apply scan signals 510-1, 510-2, . . . , and **510-*n* to the gate lines G1, G2, . . . , and Gn constituting the display panel 316, respectively. For example, while the scan signals 510-1, 510-2, . . . , and 510-*n* are applied, the pixels (e.g., pixels PX in FIG. 4) may be charged by data signals 520-1, 520-2, . . . , and 520-*n***.

For example, the scan signal 510-1 may be applied to the first gate line G1, and pixels included in the first gate line G1 may be charged by the data signal 520-1. In addition, the scan signals 510-2 to **510-*n* and the data signals 520-2 to 520-*n* are sequentially applied to the gate line G2 to the n-th gate line Gn. Accordingly, pixels included in each of the gate lines G1, G2**, . . . , and Gn may emit light.

According to various embodiments, the data signals 520-1, 520-2, . . . , and **520-*n* may have signal waveforms varied depending on the distance between the gate lines G1, G2, . . . , and Gn of the display panel 316 and the DDI 314. For example, the data signal 520-1 applied to the first gate line G1 having a relatively long distance to the DDI 314 may have a smooth curve form due to the RC delay. The data signal 520-*n* applied to the n-th gate line Gn having a relatively short distance to the DDI 314 may have a straight line form because there is absent a separate RC delay. Although FIG. 5** illustrates that the form of the data signal is varied depending on the position of the gate line, the disclosure is not limited thereto.

According to various embodiments, a time (light emission time), during which a pixel included in each gate line emits light, may be varied depending on refresh rates which are set for the DDI 314. For example, when the refresh rate is set to 60 Hz, the light emission time of each pixel may be 16.67 ms (1/60). For another example, when the refresh rate is set to 120 Hz, the light emission time of each pixel may be 8.33 ms (1/120).

According to various embodiments, the DDI 314 may change a scan time taken to display one image frame on the display panel 316. For example, the scan time is the time taken until the scan signal **510-*n* is applied to the last n-th gate line Gn after the scan signal 510-1 is applied to the first gate line G1**.

According to various embodiments, the DDI 314 may operate in various operating modes (or output modes) to prevent the increase of current consumption, heat emission, and/or the abnormal image output (e.g., flickering) in the display panel 316 variably driven at two or more refresh rates. For example, the DDI 314 may maintain the scan time when the refresh rate is changed, or may change the scan time when the refresh rate is maintained. Alternatively, the DDI 314 may change the refresh rate and the scan time.

According to an embodiment, the DDI 314 may drive the display panel 316 in a first mode of driving the display panel 316 at a first refresh rate (e.g., 60 Hz) during a first scan time (e.g., 16.67 ms), a second mode of driving the display panel 316 at the first refresh rate (e.g., 60 Hz) during a second scan time (e.g., 8.33 ms), or a third mode of driving the display panel 316 at the second refresh rate (e.g., 120 Hz) during the second scan time (e.g., 8.33 ms).

According to various embodiments, the DDI 314 may operate, in the first mode, with a first driving voltage set (power supply voltage for logic 1 (VDDR1), or power supply voltage for analog 1 (VLIN1), a first gate voltage H (VGH1), and a first gate voltage L (VGL1)), and may operate in the second mode and the third mode, with a second driving voltage set (VDDR2 or VLIN2), a second gate voltage H (VGH2), and a second gate voltage L (VGL2)).

According to various embodiments, the DDI 314 may set different gamma values for the first to third modes, respectively. A first gamma value may be applied to the first mode, a second gamma value may be applied to the second mode, and a third gamma value may be applied to the third mode. The mutually different gamma values may compensate for a leakage current value in a pixel and may improve a brightness difference between modes.

According to various embodiments, the first scan time in the first mode may be equal to or shorter than a first light emission time (e.g., 16.67 ms) of pixels, which is determined based on the first refresh rate (e.g., 60 Hz). In addition, the second scan time in the second mode and the third mode may be equal to or shorter than a second light emission time (e.g., 8.33 ms) of pixels, which is determined based on the second refresh rate (e.g., 120 Hz).

Although the following description will be made while focusing on that the DDI 314 operates in the first mode to the third mode, the disclosure is not limited thereto.

Figure 6A:
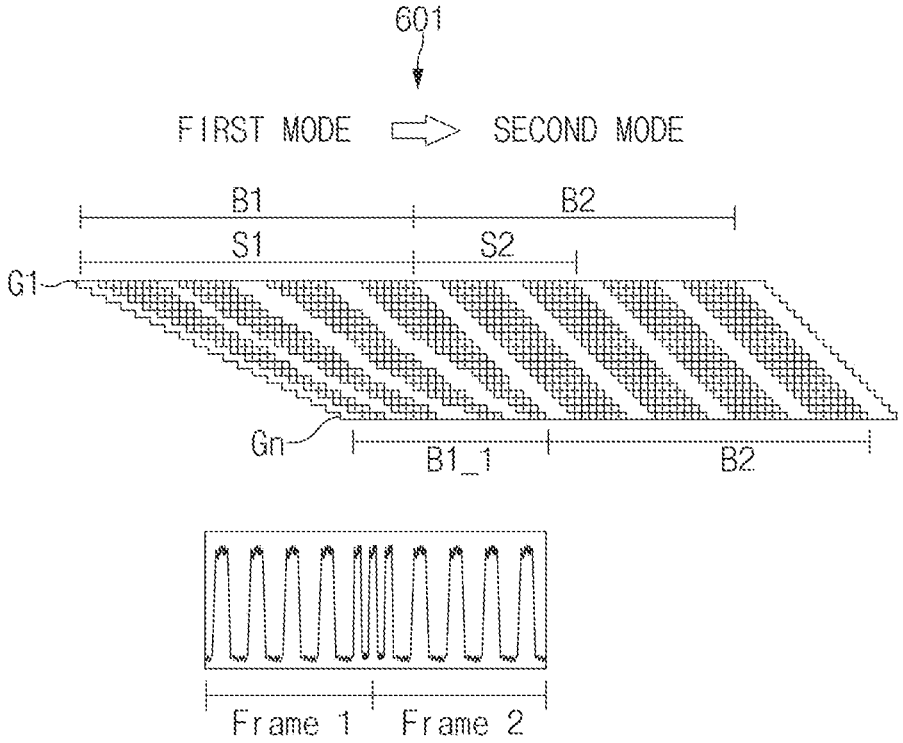
FIGS. 6A and 6B are timing diagrams for driving of a display panel when a refresh rate is changed to a higher rate, according to various embodiments.
Figure 6B:
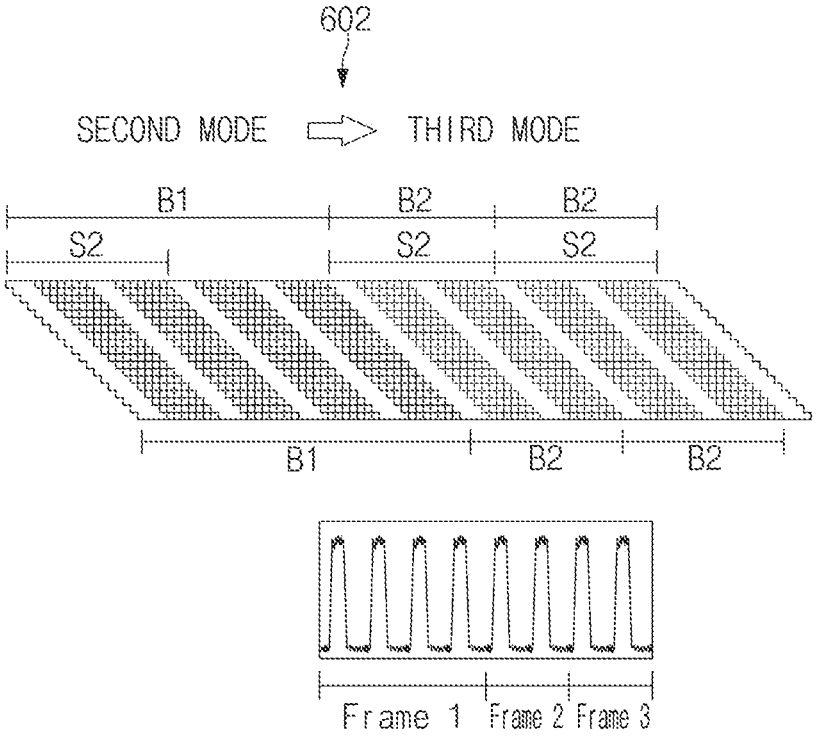

FIGS. 6A and 6B illustrate a display panel when a refresh rate is changed to a higher rate according to various embodiments. FIGS. 6A and 6B are provided for the illustrative purpose, and the disclosure is not limited thereto.

Referring to FIGS. 6A and 6B, a DDI (e.g., the DDI 314 in FIG. 3) may drive the display panel 316 in one of the first mode having the first refresh rate (e.g., 60 Hz) and the first scan time (e.g., 16.67 ms), the second mode having the first refresh rate (e.g., 60 Hz) and the second scan time (e.g., 8.33 ms), or a third mode having the second refresh rate (e.g., 120 Hz) and the second scan time (e.g., 8.33 ms). The DDI 314 may receive a control signal, which is for changing a mode, from the processor 312 and may change the mode in response to the control signal. The control signal may be transmitted while being contained in image data (e.g., RGB data), or may be transmitted separately from image data (e.g., RGB data).

In a first timing diagram 601 of FIG. 6A, the DDI 314 may drive the display panel 316 by changing the mode from the first mode to the second mode. When the mode is changed from the first mode to the second mode, the refresh rate may be maintained. Accordingly, a first light emission time B1 may be identically maintained in each pixel. For example, in the first mode and the second mode, light emission times may be maintained to the first light emission time B1 (e.g., 16.67 ms). According to various embodiments, in the first mode and the second mode, the DDI 314 may output one image frame (Frame 1, or Frame 2) through four clock signals.

According to various embodiments, when the mode is changed from the first mode to the second mode, the DDI 314 may change the scan time. In the first mode, the DDI 314 may drive the display panel 316 during the first scan time S1 (e.g., 16.67 ms) corresponding to the first refresh rate (e.g., 60 Hz). In the second mode, the DDI 314 may drive the display panel 316 during the second scan time S2 (e.g., 8.33 ms) shorter than the first scan time S1 (e.g., 16.67 ms). In an embodiment, the second scan time S2 (e.g., 8.33 ms) may be set to correspond to the second refresh rate (e.g., 120 Hz) greater than the first refresh rate (e.g., 60 Hz).

According to various embodiments, the light emission time for the first gate line G1 may be maintained to the first light emission time B1 (e.g., 16.67 ms). The light emission time (B1_1) of the last n-th gate line Gn may be shorter than the first light emission time B1 (e.g., 16.67 ms) because the second mode starts from the first gate line G1. The DDI 314 may apply the different gamma values in the first mode and the second mode to compensate for a leakage current value in a pixel, and improve a brightness difference between the first mode and the second mode.

In a second timing diagram 602 of FIG. 6B, the DDI 314 may drive the display panel 316 by changing the mode from the second mode to the third mode. When the mode is changed from the second mode to the third mode, the refresh rate may be changed (e.g., changed from 60 Hz to 120 Hz). Accordingly, the light emission time of each pixel may be shortened. For example, the light emission time in the second mode may be the first light emission time B1 (e.g., 16.67 ms). In the second mode, the DDI 314 may output one image frame (Frame 1) through four clock signals.

According to various embodiments, in the third mode, the light emission time may be changed to a second light emission time B2 (e.g., 8.33 ms). The DDI 314 may output one image frame (Frame 2 or Frame 3) through two clock signals.

According to various embodiments, when the mode is changed from the second mode to the third mode, the DDI 314 may change the scan time. In the second mode and the third mode, the DDI 314 may drive the display panel 316 during the second scan time S2 (e.g., 8.33 ms) corresponding to the second refresh rate (e.g., 120 Hz).

When the mode is changed from the first mode to the third mode, because the refresh rate and the scan time are changed, the light emission time B1 (e.g., 16.67 ms) may not be ensured as a gate line approaches toward the last gate line (e.g., the n-th gate line Gn), which is different from that of FIG. 6B. Accordingly, flickering on the display panel 316 may be viewed by a user, which causes the user to feel inconvenient. Meanwhile, as illustrated in FIG. 6B, when the mode is changed from the second mode to the third mode, the similar operating characteristics may be appeared in mode change, and the flickering may not be viewed on the screen. In addition, the DDI 314 may reduce the brightness difference by correcting the gamma value when the mode is changed.

Figure 7A:
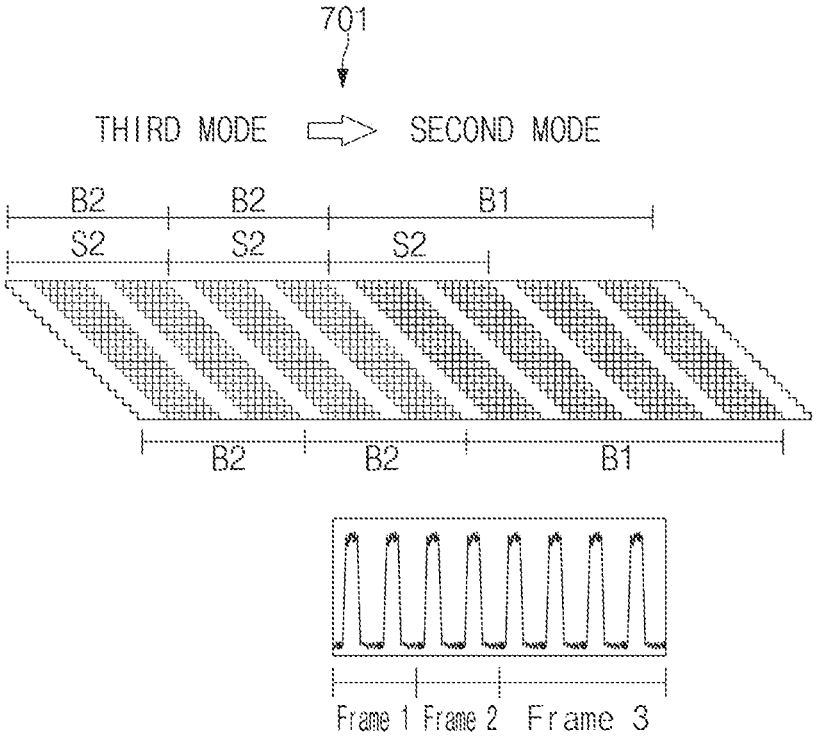
FIGS. 7A and 7B are timing diagrams for driving of a display panel when a refresh rate is changed to a lower rate, according to various embodiments.
Figure 7B:
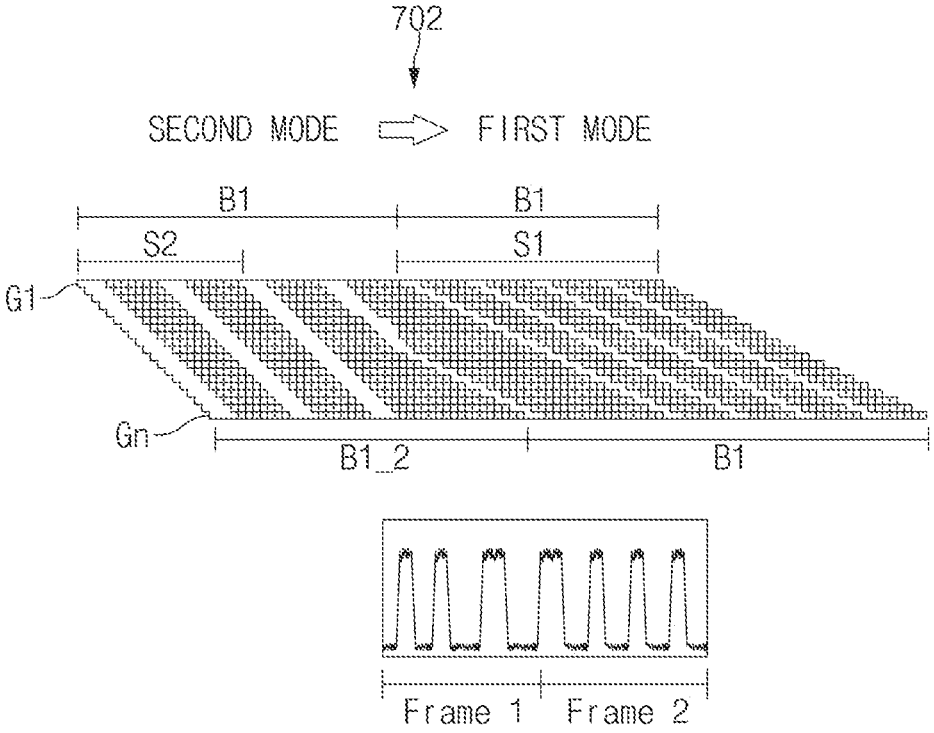

FIGS. 7A and 7B illustrate a display panel when a refresh rate is changed to a lower rate according to various embodiments. FIGS. 7A and 7B are provided for the illustrative purpose, the disclosure is not limited thereto.

Referring to FIGS. 7A and 7B, a DDI (e.g., the DDI 314 in FIG. 3) may drive the display panel 316 in one of the first mode having the first refresh rate (e.g., 60 Hz) and the first scan time (e.g., 16.67 ms), the second mode having the first refresh rate (e.g., 60 Hz) and the second scan time (e.g., 8.33 ms), or the third mode having the second refresh rate (e.g., 120 Hz) and the second scan time (e.g., 8.33 ms). The DDI 314 may receive a control signal for changing a mode, from the processor 312 and may change the mode in response to the control signal. The control signal may be transmitted while being contained in image data (e.g., RGB data), or may be transmitted separately from image data (e.g., RGB data).

In a first timing diagram 701 of FIG. 7A, the DDI 314 may drive the display panel 316 by changing the mode from the third mode to the second mode. When the mode is changed from the third mode to the second mode, the refresh rate may be changed (e.g., changed from 120 Hz to 60 Hz). Accordingly, the light emission time of each pixel may be increased. For example, the light emission time in the third mode may be maintained to the second light emission time B2 (e.g., 8.33 ms). In the third mode, the DDI 314 may output one image frame (Frame 1 or Frame 2) through two clock signals.

According to various embodiments, in the second mode, the light emission time may be changed to the first light emission time B1 (e.g., 16.67 ms). The DDI 314 may output one image frame (Frame 4) by four clock signals.

According to various embodiments, when the mode is changed from the third mode to the second mode, the DDI 314 may maintain the scan time. In the third mode and the second mode, the DDI 314 may drive the display panel 316 during the second scan time S2 (e.g., 8.33 ms) corresponding to the second refresh rate (e.g., 120 Hz).

In a second timing diagram 702 of FIG. 7B, the DDI 314 may drive the display panel 316 by changing the mode from the second mode to the first mode. When the mode is changed from the second mode to the first mode, the refresh rate may be maintained. Accordingly, the light emission time B1 may be identically maintained in each pixel. For example, in the first mode and the second mode, the light emission time may be maintained to the first light emission time B1 (e.g., 16.67 ms).

According to various embodiments, in the first mode and the second mode, the DDI 314 may output one image frame (Frame 1, or Frame 2) through four clock signals.

According to various embodiments, when the mode is changed from the second mode to the first mode, the DDI 314 may change the scan time. In the second mode, the DDI 314 may drive the display panel 316 during the second scan time S2 (e.g., 8.33 ms) corresponding to the second refresh rate (e.g., 120 Hz). In the first mode, the DDI 314 may drive the display panel 316 during the first scan time S1 (e.g., 16.67 ms) longer than the second scan time S2 (e.g., 8.33 ms).

According to an embodiment, the first scan time S1 (e.g., 16.67 ms) may be set to correspond to the first refresh rate (e.g., 60 Hz) shorter than the second refresh rate (e.g., 120 Hz).

According to various embodiments, the light emission time for the first gate line G1 may be maintained to the first light emission time B1 (e.g., 16.67 ms). The light emission time of the last n-th gate line Gn may be longer than the first light emission time B1 (e.g., 16.67 ms) because the first mode starts from the first gate line G1.

The DDT 314 may apply different gamma values in the first mode and the second mode to compensate for a leakage current value in a pixel, and improve a brightness difference between the first mode and the second mode. According to an embodiment, when the mode is changed from the second mode to the first mode, the DDI 314 may add a black image, an alpha image, or an animation image to prevent a screen from being flickered due to the change in the scan time.

Figure 8A:
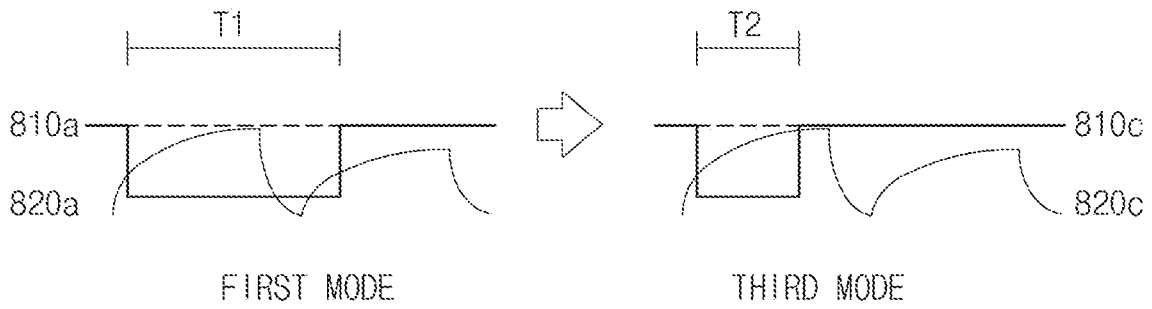
FIGS. 8A and 8B illustrates a brightness difference resulting from a change in mode, according to various embodiments.
Figure 8A:
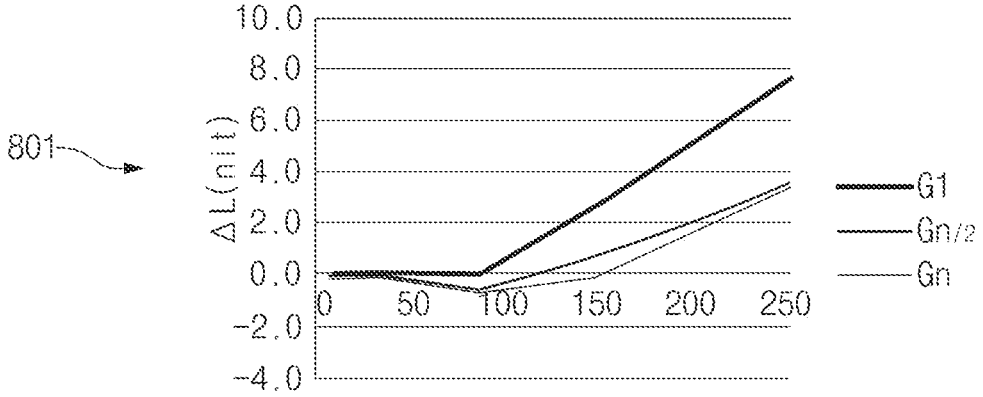
Figure 8B:
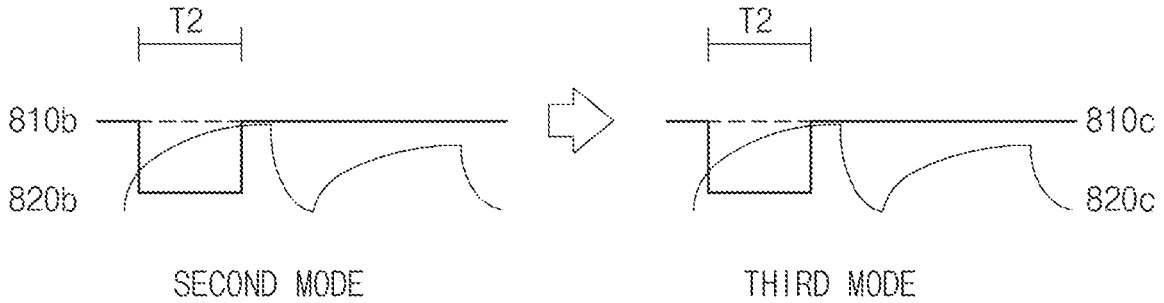
Figure 8B:
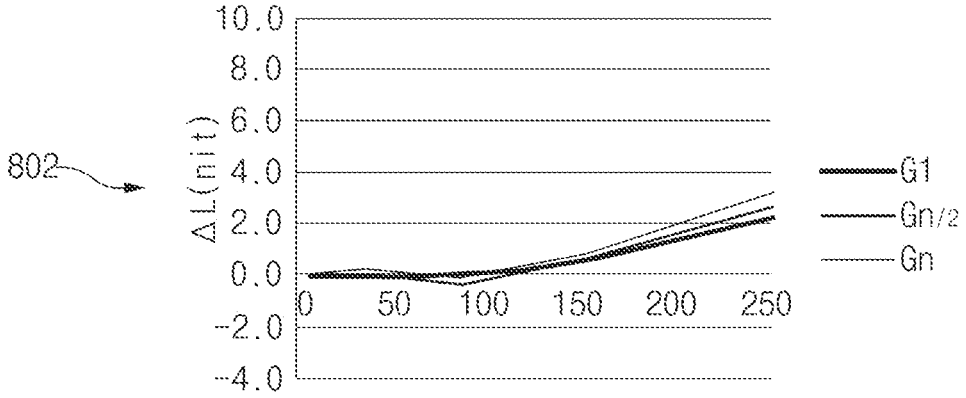

FIGS. 8A and 8B illustrate a brightness difference resulting from a change in mode according to various embodiments.

Referring to FIGS. 8A and 8B, the DDI (e.g., the DDI 314 in FIG. 3) may drive the display panel 316 in a first mode of driving the display panel 316 at a first refresh rate (e.g., 60 Hz) during a first scan time (e.g., 16.67 ms), a second mode of driving the display panel 316 at the first refresh rate (e.g., 60 Hz) during a second scan time (e.g., 8.33 ms), or a third mode of driving the display panel 316 at the second refresh rate (e.g., 120 Hz) during the second scan time (e.g., 8.33 ms).

Referring to FIG. 8A, in the first mode, a scan signal 810*a* may be sequentially applied to gate lines (e.g., the gate lines G1, G2, . . . , and Gn in FIG. 4) constituting the display panel (e.g., the display panel 316 in FIG. 3). For example, while the scan signal 810*a* is applied, each pixel may be charged by a data signal 820*a*. In the third mode, a scan signal 810*c* may be sequentially applied to the gate lines constituting the display panel 316. While the scan signal is applied, each pixel may be charged by a data signal 820*c*.

When the mode is changed from the first mode to the third mode, a refresh rate and a scan time may be changed. For example, regarding the scan time, the scan signal 810*a* may have a first activation duration T1 in the first mode, and the scan signal 810*c* may have a second activation duration T2 shorter than the first activation duration T1. Accordingly, the significant brightness difference may be made in each pixel. For example, in a first graph 801, the brightness difference before and after the mode is changed may show the highest value in the first gate line G1, and may show the lower value in an n/2-th gate line Gn/2 or the n-th gate line Gn. The brightness difference may show a higher value in the entire portion of the display panel 316.

According to various embodiments, when the mode is changed from the first mode to the third mode, the DDI 314 may add a black image, an alpha image, or an animation image to prevent a screen from being flickered.

Referring to FIG. 8B, in the second mode, a scan signal 810*b* may be sequentially applied to gate lines constituting the display panel (e.g., the display panel 316 in FIG. 3). While the scan signal is applied, each pixel may be charged by a data signal 820*b*.

In the third mode, the scan signal 810*c* may be sequentially applied to the gate lines constituting the display panel 316. While the scan signal is applied, each pixel may be charged by the data signal 820*c*.

When the mode is changed from the second mode to the third mode, a refresh rate may be changed, and a scan time may be identically maintained. For example, regarding the scan time, the scan signal 810*b* in the second mode and the scan signal 810*c* in the third mode may have the second activation duration T2 shorter than the first activation duration T1 in the first mode. Accordingly, the brightness difference in each pixel may be reduced. For example, in a second graph 802, the first gate line G1, the n/2-th gate line Gn/2, which is positioned at an intermediate portion, and the n-th gate line Gn, which is positioned at the last portion, may have brightness having similar intensities, instead of a great brightness difference.

Figure 9:
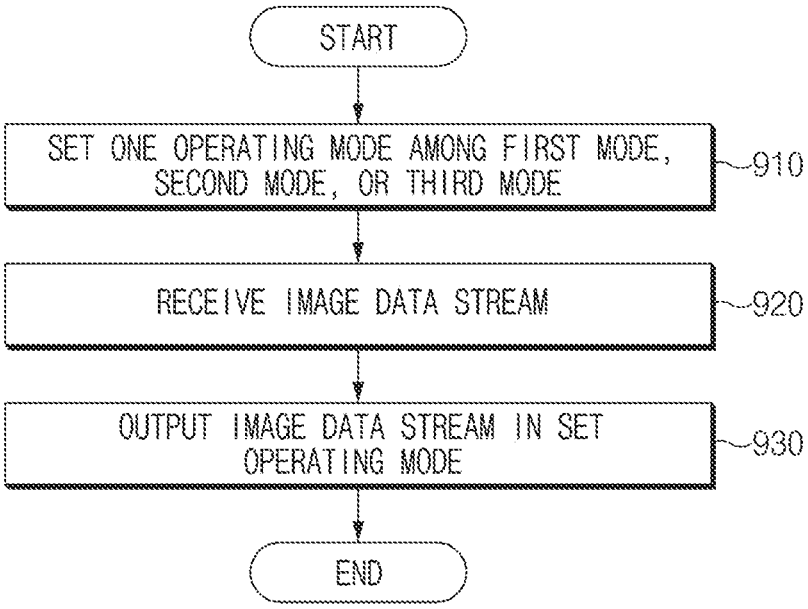
FIG. 9 is a flowchart illustrating a method for displaying a screen, according to various embodiments.

FIG. 9 is a flowchart illustrating a method for displaying a screen, according to various embodiments.

Referring to FIG. 9, in operation 910, a DDI (e.g., the DDI 314 in FIG. 3) may drive the display panel 316 in one operating mode of the first mode having the first refresh rate (e.g., 60 Hz) and the first scan time (e.g., 16.67 ms), the second mode having the first refresh rate (e.g., 60 Hz) and the second scan time (e.g., 8.33 ms), or a third mode having the second refresh rate (e.g., 120 Hz) and the second scan time (e.g., 8.33 ms).

According to various embodiments, the DDI 314 may receive a control signal for setting of an operating mode, from the processor (e.g., the processor 312 in FIG. 3) and may set the operating mode in response to the control signal.

Although various embodiments have been described regarding that the DDI (e.g., the DDI 314 in operation 3) drives the display panel 316 in various operating modes according to various embodiments of the disclosure, the disclosure is not limited thereto. For example, an electronic device (e.g., the electronic device 310 in FIG. 3) may include a DDI (e.g., the DDI 314 of FIG. 3) and a processor (e.g., the processor 312 of FIG. 3) which are integrally implemented in one module.

According to various embodiments, a processor (e.g., the processor 312 in FIG. 3) may determine a mode of driving a display panel (e.g., the display panel 316 in FIG. 3) based on data (e.g., a type of an application or a type of an image) displayed on the electronic device (e.g., the electronic device 310 in FIG. 3), and may control the display panel (e.g., the display panel 316 in FIG. 3) using the determined mode. For example, the processor (e.g., the processor 312 in FIG. 3) may set a refresh rate, based on whether a user input (e.g., a scroll input) is made, information on external illuminance, information on the brightness of the display panel 316, or information such as on pixel ratio (OPR).

In operation 920, the DDI 314 may receive an image data stream (e.g., image data) from the processor 312.

In operation 930, the DDI 314 may output an image data stream through the display panel (e.g., the display panel 316 in FIG. 3) in the set operating mode.

Figure 10:
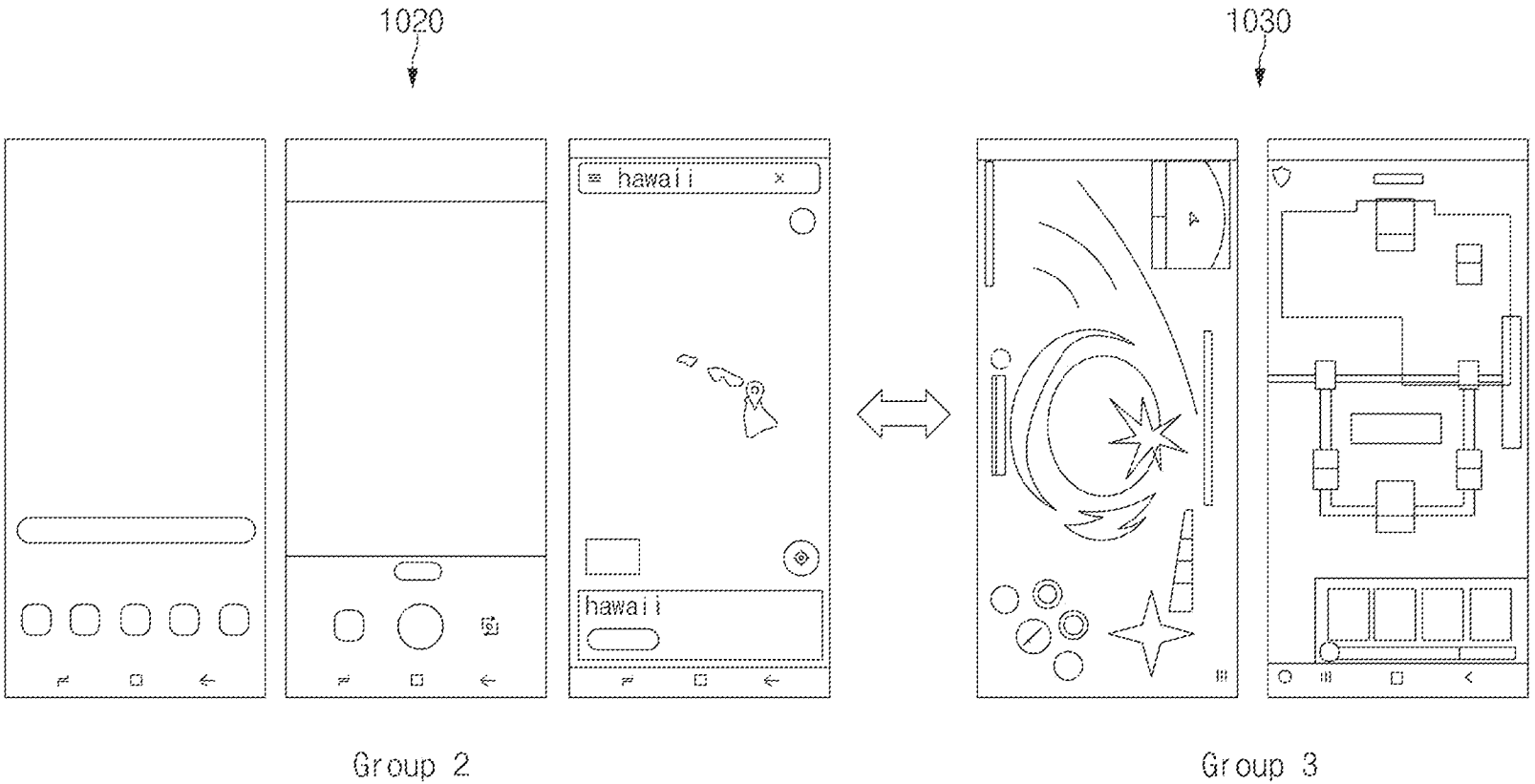
FIG. 10 illustrates switching between a second mode and a third mode when an application is switched, according to various embodiments.

FIG. 10 illustrates switching between a second mode and a third mode when an application is switched, according to various embodiments.

Referring to FIG. 10, a DDI (e.g., the DDI 314 in FIG. 3) may drive the display panel (e.g., the display panel 316 in FIG. 3) in the first mode having the first refresh rate (e.g., 60 Hz) and the first scan time (e.g., 16.67 ms), the second mode having the first refresh rate (e.g., 60 Hz) and the second scan time (e.g., 8.33 ms), or the third mode having the second refresh rate (e.g., 120 Hz) and the second scan time (e.g., 8.33 ms). A mode of driving the display panel 316 is not limited to the above-described embodiments, but various modes of driving the display panel 316 may be set according to various embodiments. For example, a fourth mode having the second refresh rate (e.g., 120 Hz) and the first scan time (e.g., 16.67 ms) may be included.

For example, the DDI 314 may receive a control signal for changing a mode from the processor 312 and change the mode in response to the control signal.

According to various embodiments, the processor 312 may transmit the control signal to the DDI 314 to change a mode to be executed depending on the type of an application running in foreground.

According to an embodiment, when at least two applications are running in foreground with multiple windows or a pop-up window, a specified one mode may be executed or a different mode may be executed in each area (e.g., each area of the multiple windows)

According to an embodiment, the processor 312 may set a first application group (Group 1; not illustrated) operating in the first mode, a second application group (Group 2; 1020) operating in the second mode, and a third application group (Group 3; 1030) operating in the third mode. For example, the second application group (Group 2; 1020) may include a home application, a camera application, or a map application, and the third application group (Group 3; 1030) may include a game application.

For example, the processor 312 may transmit, to the DDI 314, a control signal allowing the operation in the third mode, when executing an application included in the third application group (Group 3; 1030) while an application included in the second application group (Group 2; 1020) is running. The scan time may be identically maintained and the set driving voltage may be identically maintained, between the second mode and the third mode. Accordingly, when the mode is changed from the second mode to the third mode, the flickering on the screen may not be viewed. In addition, when the mode is changed, the DDI 314 may reduce the brightness difference by correcting the gamma value.

According to various embodiments, when executing an application in the second application group (Group 2; 1020) or the third application group (Group 3; 1030) in foreground while the application in the first application group is running in foreground, an image may be added and displayed to prevent the flickering caused by the difference in scan time and/or driving voltage. For example, the DDI 314 may add a black image, an alpha layer, or an animation image in synchronization with a duration in which the brightness difference is made or flickering is viewed. In addition, the DDI 314 may adjust a ratio for turning on the light emitting device by adding an algorithm having amoled off ratio (AOR) values varied depending on panel positions. Accordingly, the flickering caused by the change in the scan time may be prevented. Alternatively, the DDI 314 may apply an algorithm for reflecting AORs varied depending on panel positions when generating the black image, the alpha layer, or the animation image.

Figure 11:
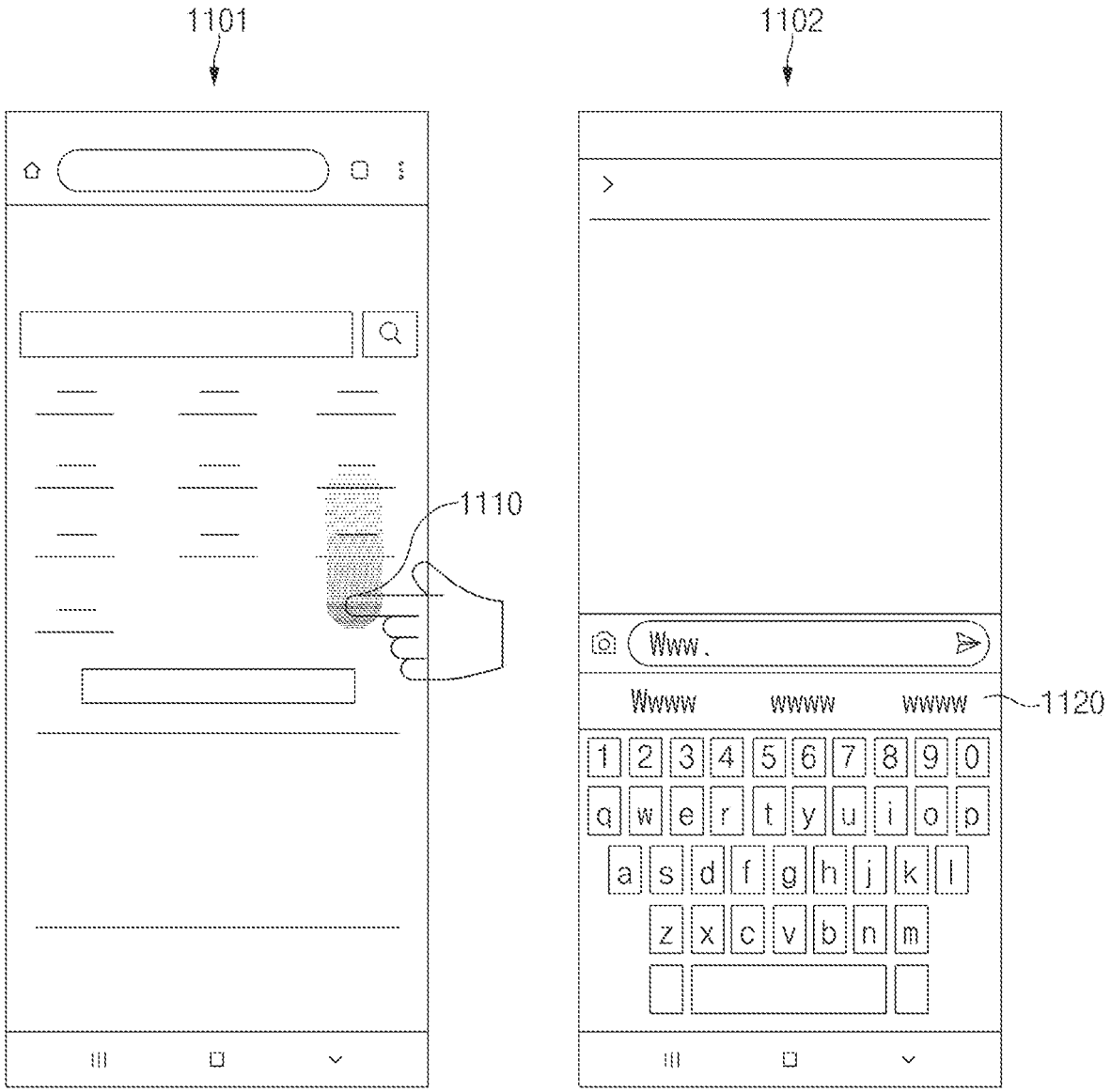
FIG. 11 illustrates a screen showing switching between a second mode and a third mode while an application is running, according to various embodiments.

FIG. 11 illustrates a screen showing switching between a second mode and a third mode while an application is running, according to various embodiments.

Referring to FIG. 11, a processor (e.g., the processor 312 in FIG. 3) may operate the second mode or the third mode in a seamless manner while the application is running. For example, when executing a web-search application 1101, the processor 312 may transmit a control signal for operating in the second mode to the DDI (for example, the DDI 314 of FIG. 3) in the state in which there is no user input. The processor 312 may transmit a control signal for operating in the third mode to the DDI 314, when a user input 1110 is made and scrolling occurs on the screen.

For example, when executing a message application 1102, the processor 312 may transmit a control signal for operating in the second mode to the DDI 314 in the state in which there is no user input. When a keyboard 1120 for a text input is displayed, the processor 312 may transmit a control signal for operating in the third mode to the DDI 314

The identical or similar scan time and the identical or similar driving voltage may be provided, between the second mode and the third mode. Accordingly, when the mode is changed from the second mode to the third mode, the flickering on the screen may not be viewed. In addition, when the mode is changed, the DDI 314 may reduce the brightness difference by correcting the gamma value. Accordingly, a scrolled screen may be displayed without flickering, and the keyboard may be naturally displayed on the screen.

According to various embodiments, the processor 312 may operate by varying the settings for components (e.g., an AP, graphical user interface (GUI), or sensor) other than the display panel 316, to seamlessly implement the second mode and the third mode and to improve additional current consumption.

The electronic device according to various embodiments disclosed in the disclosure may be various types of devices. The electronic device may include, for example, a portable communication device (e.g., a smartphone), a computer device, a portable multimedia device, a mobile medical appliance, a camera, a wearable device, or a home appliance. The electronic device according to an embodiment of the disclosure should not be limited to the above-mentioned devices.

In the disclosure disclosed herein, each of the expressions "A or B", "at least one of A and B", "at least one of A or B", "A, B, or C", "one or more of A, B, and C", or "one or more of A, B, or C", and the like used herein may include any and all combinations of one or more of the associated listed items. The expressions, such as "a first", "a second", "the first", or "the second", may be used merely for the purpose of distinguishing a component from the other components, but do not limit the corresponding components in other aspect (e.g., the importance or the order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

The term "module" used in the disclosure may include a unit implemented in hardware, software, or firmware and may be interchangeably used with the terms "logic", "logical block", "part" and "circuit". The "module" may be a minimum unit of an integrated part or may be a part thereof. The "module" may be a minimum unit for performing one or more functions or a part thereof. For example, according to an embodiment, the "module" may include an application-specific integrated circuit (ASIC).

Various embodiments of the disclosure may be implemented by software (e.g., the program 140) including an instruction stored in a machine-readable storage medium (e.g., an internal memory 136 or an external memory 138) readable by a machine (e.g., the electronic device 101). For example, the processor (e.g., the processor 120) of a machine (e.g., the electronic device 101) may call the instruction from the machine-readable storage medium and execute the instructions thus called. This means that the machine may perform at least one function based on the called at least one instruction. The one or more instructions may include a code generated by a compiler or executable by an interpreter. The machine-readable storage medium may be provided in the form of non-transitory storage medium. Here, the term "non-transitory", as used herein, means that the storage medium is tangible, but does not include a signal (e.g., an electromagnetic wave). The term "non-transitory" does not differentiate a case where the data is permanently stored in the storage medium from a case where the data is temporally stored in the storage medium.

According to an embodiment, the method according to various embodiments disclosed in the disclosure may be provided as a part of a computer program product. The computer program product may be traded between a seller and a buyer as a product. The computer program product may be distributed in the form of machine-readable storage medium (e.g., a compact disc read only memory (CD-ROM)) or may be directly distributed (e.g., download or upload) online through an application store (e.g., a Play Store™) or between two user devices (e.g., the smartphones). In the case of online distribution, at least a portion of the computer program product may be temporarily stored or generated in a machine-readable storage medium such as a memory of a manufacturer's server, an application store's server, or a relay server.

According to various embodiments, each component (e.g., the module or the program) of the above-described components may include one or plural entities. According to various embodiments, at least one or more components of the above components or operations may be omitted, or one or more components or operations may be added. Alternatively or additionally, some components (e.g., the module or the program) may be integrated in one component. In this case, the integrated component may perform the same or similar functions performed by each corresponding components prior to the integration. According to various embodiments, operations performed by a module, a programming, or other components may be executed sequentially, in parallel, repeatedly, or in a heuristic method, or at least some operations may be executed in different sequences, omitted, or other operations may be added.

According to various embodiments, an electronic device (e.g., the electronic device 101 in FIG. 1, or the electronic device 310 in FIG. 3) may include a display panel (e.g., the display device 160 in FIG. 1 or the display panel 316 in FIG. 3), a display driver integrated circuit (e.g., the display driver integrated circuit 314 in FIG. 3)(display driver IC) to drive the display panel (e.g., the display device 160 in FIG. 1 or the display panel 316 in FIG. 3), and a processor (e.g., the processor 120 in FIG. 1 or the processor 312 in FIG. 3) operatively connected with the display panel (e.g., the display device 160 in FIG. 1 or the display panel 316 in FIG. 3) and the display driver IC (e.g., the display driver IC 314 in FIG. 3). The display driver IC (e.g., the display driver IC 314 in FIG. 3) is configured to set an operating mode including a first mode having a first refresh rate and a first scan time, a second mode having the first refresh rate and a second scan time, and a third mode having a second refresh rate and the second scan time, receive an image data stream from the processor (e.g., the processor 120 in FIG. 1 or the processor 312 in FIG. 3), and output the image data stream in one of the operating mode through the display panel (e.g., the display device 160 in FIG. 1 or the display panel 316 in FIG. 3).

According to various embodiments, the display driver IC (e.g., the display driver IC 314 in FIG. 3) may be configured to receive a control signal for changing the operating mode from the processor (e.g., the processor 120 in FIG. 1 or the processor 312 in FIG. 3), and change the operating mode to correspond to the control signal.

According to various embodiments, the display driver IC (e.g., the display driver IC 314 in FIG. 3) may configured to maintain a driving voltage for the display panel (e.g., the display device 160 in FIG. 1 or the display panel 316 in FIG. 3), between the second mode and the third mode.

According to various embodiments, the display driver IC (e.g., the display driver IC 314 in FIG. 3) may be configured to change a driving voltage for the display panel (e.g., the display device 160 in FIG. 1 or the display panel 316 in FIG. 3), between the first mode and the second mode.

According to various embodiments, the display driver IC (e.g., the display driver IC 314 in FIG. 3) may be configured to output one image frame based on a first number of clock signals, in the first mode and the second mode, and may output one image frame based on a second number of clock signals smaller than the first number of clock signals, in the third mode.

According to various embodiments, the display driver IC (e.g., the display driver IC 314 in FIG. 3) may be configured to set the first scan time to be equal to or shorter than a first light emission time of a pixel of the display panel (e.g., the display device 160 in FIG. 1 or the display panel 316 in FIG. 3) with respect to the first refresh rate, in the first mode.

According to various embodiments, the display driver IC (e.g., the display driver IC 314 in FIG. 3) may be configured to set the second scan time to be equal to or shorter than a second light emission time of a pixel of the display panel (e.g., the display device 160 in FIG. 1 or the display panel 316 in FIG. 3) with respect to the second refresh rate, in the second mode and the third mode.

According to various embodiments, the display driver IC (e.g., the display driver IC 314 in FIG. 3) may be configured to apply mutually different gamma values in the first mode, the second mode, and the third mode, respectively.

According to various embodiments, the display driver IC (e.g., the display driver IC 314 in FIG. 3) may be configured to further output an additional image, when switching of the operating mode occurs. The additional image may be one of a black image, an alpha image, or an animation image.

According to various embodiments, the processor (e.g., the processor 120 in FIG. 1 or the processor 312 in FIG. 3) may be configured to identify an application which is running in the electronic device (e.g., the electronic device 101 in FIG. 1, or the electronic device 310 in FIG. 3), and transmit a control signal for changing the operating mode of the display driver IC (e.g., the display driver IC 314 in FIG. 3), depending on a type of the identified application.

According to various embodiments, a type of the application may include a first application group corresponding to the first mode, a second application group corresponding to the second mode, and a third application group corresponding to the third mode, and the processor (e.g., the processor 120 in FIG. 1 or the processor 312 in FIG. 3) may be configured to determine whether a group of the identified application is changed to the second application group or the third application group from the first application group and transmit the control signal, when the group of the identified application is changed to the second application group or the third application group from the first application group.

According to various embodiments, the processor (e.g., the processor 120 in FIG. 1 or the processor 312 in FIG. 3) may be configured to receive a user input using the display panel (e.g., the display device 160 in FIG. 1 or the display panel 316 in FIG. 3), identify the operating mode corresponding to the received user input, and transmit a control signal for changing the operating mode of the display driver IC (e.g., the display driver IC 314 in FIG. 3), based on the identified operating mode.

According to various embodiments, the first refresh rate may include 60 Hz, and the second refresh rate may include 120 Hz.

According to various embodiments, a method for displaying a screen may be performed in an electronic device (e.g., the electronic device 101 in FIG. 1 or the electronic device 310 in FIG. 3) including a display panel (e.g., the display device 160 in FIG. 1 or the display panel 316 in FIG. 3). The method may include setting an operating mode including a first mode having a first refresh rate and a first scan time, a second mode having the first refresh rate and a second scan time, and a third mode having a second refresh rate and the second scan time, in a display driver IC (e.g., the display driver IC 314 in FIG. 3) to drive the display panel (e.g., the display device 160 in FIG. 1 or the display panel 316 in FIG. 3), receiving, at the display driver IC (e.g., the display driver IC 314 in FIG. 3), an image data stream from a processor (e.g., the processor 120 in FIG. 1 or the processor 312 in FIG. 3) of the electronic device (e.g., the electronic device 101 in FIG. 1 or the electronic device 310 in FIG. 3), and outputting the image data stream through the display panel (e.g., the display device 160 in FIG. 1 or the display panel 316 in FIG. 3) in one of the operating mode.

According to various embodiments, the outputting of the image data stream may include receiving a control signal for changing the operating mode from the processor (e.g., the processor 120 in FIG. 1 or the processor 312 in FIG. 3), and changing the operating mode to correspond to the control signal.

According to various embodiments, the setting of the operating mode may include maintaining a driving voltage for the display panel (e.g., the display device 160 in FIG. 1 or the display panel 316 in FIG. 3), when the operating mode is changed between the second mode and the third mode.

According to various embodiments, the setting of the operating mode may include changing a driving voltage for the display panel (e.g., the display device 160 in FIG. 1 or the display panel 316 in FIG. 3), when the operating mode is changed between the first mode and the second mode.

According to various embodiments, the setting of the operating mode may include setting the first scan time to be equal to or shorter than a first light emission time of a pixel of the display panel (e.g., the display device 160 in FIG. 1 or the display panel 316 in FIG. 3) with respect to the first refresh rate, in the first mode.

According to various embodiments, a storage medium may have instructions, in which the instructions, when executed by at least one processor, may be configured to cause the at least one processor to perform at least one operation and the at least one operation may include setting an operating mode including a first mode having a first refresh rate and a first scan time, a second mode having the first refresh rate and a second scan time, and a third mode having a second refresh rate and the second scan time, displaying an image by using a display panel (e.g., the display device 160 in FIG. 1 or the display panel 316 in FIG. 3) operatively connected with the processor, receiving a user input onto the display panel (e.g., the display device 160 in FIG. 1 or the display panel 316 in FIG. 3), identifying the operating mode corresponding to the received user input, and displaying another image associated with the image, based on the identified operating mode.

The identifying of the operating mode may include identifying an application, which is running, based on the user input, and determining the operating mode, based on a type of the identified application.

The invention claimed is:

1. An electronic device comprising:

a display panel;

a display driver integrated circuit (IC) configured to drive the display panel; and a processor operatively connected with the display panel and the display driver IC, wherein the display driver IC is configured to:

set an operating mode including a first operating mode having a first refresh rate and a first scan time, a second operating mode having the first refresh rate and a second scan time, and a third operating mode having a second refresh rate and the second scan time, receive an image data stream from the processor, and output the image data stream in one of the operating mode through the display panel.

2. The electronic device of claim 1, wherein the display driver IC is configured to:

receive a control signal for changing the operating mode from the processor, and change the operating mode to correspond to the control signal.

3. The electronic device of claim 1, wherein the display driver IC is configured to:

maintain a driving voltage for the display panel, when the operating mode is changed between the second operating mode and the third operating mode.

4. The electronic device of claim 1, wherein the display driver IC is configured to:

change a driving voltage for the display panel, when the operating mode is changed between the first operating mode and the second operating mode.

5. The electronic device of claim 1, wherein the display driver IC is configured to:

output one image frame based on a first number of clock signals, in the first operating mode and the second operating mode, and output one image frame based on a second number of clock signals smaller than the first number of clock signals, in the third operating mode.

6. The electronic device of claim 1, wherein the display driver IC is configured to:

set the first scan time to be equal to or shorter than a first light emission time of a pixel of the display panel with respect to the first refresh rate, in the first operating mode.

7. The electronic device of claim 1, wherein the display driver IC is configured to:

set the second scan time to be equal to or shorter than a second light emission time of a pixel of the display panel with respect to the second refresh rate, in the second operating mode and the third operating mode.

8. The electronic device of claim 1, wherein the display driver IC is configured to:

apply mutually different gamma values in the first operating mode, the second operating mode, and the third operating mode, respectively.

9. The electronic device of claim 1, wherein the display driver IC is configured to:

further output an additional image, when switching of the operating mode occurs.

10. The electronic device of claim 1, wherein the processor is configured to:

identify an application which is running in the electronic device, and transmit a control signal for changing the operating mode of the display driver IC, depending on a type of the identified application.

11. The electronic device of claim 10, wherein a type of the application comprises:

a first application group corresponding to the first operating mode, a second application group corresponding to the second operating mode, and a third application group corresponding to the third operating mode, and wherein the processor is configured to:

determine whether a group of the identified application is changed to the second application group or the third application group from the first application group, and transmit the control signal, when the group of the identified application is changed to the second application group or the third application group from the first application group.

12. The electronic device of claim 1, wherein the processor is configured to:

receive a user input using the display panel, identify the operating mode corresponding to the received user input, and transmit a control signal for changing the operating mode of the display driver IC, based on the identified operating mode.

13. The electronic device of claim 1, wherein the first refresh rate includes 60 Hz, and wherein the second refresh rate includes 120 Hz.

14. A method for displaying a screen, which is performed in an electronic device including a display panel, the method comprising:

setting an operating mode including a first mode having a first refresh rate and a first scan time, a second mode having the first refresh rate and a second scan time, and a third mode having a second refresh rate and the second scan time, at a display driver IC to drive the display panel;

receiving, at the display driver IC, an image data stream from a processor of the electronic device; and outputting the image data stream through the display panel in one of the operating mode.

15. The method of claim 14, wherein the outputting of the image data stream comprises:

receiving a control signal for changing the operating mode from the processor; and changing the operating mode to correspond to the control signal.

16. The method of claim 14, wherein the setting of the operating mode comprises maintaining a driving voltage for the display panel, when the operating mode is changed between the second mode and the third mode.

17. The method of claim 14, wherein the setting of the operating mode comprises changing a driving voltage for the display panel, when the operating mode is changed between the first mode and the second mode.

18. The method of claim 14, wherein the setting of the operating mode comprises setting the first scan time to be equal to or shorter than a first light emission time of a pixel of the display panel with respect to the first refresh rate, in the first mode.

19. A non-transitory storage medium having instructions, wherein the instructions, when executed by at least one processor, are configured to cause the at least one processor to perform at least one operation and wherein the at least one operation comprises:

setting an operating mode including a first operating mode having a first refresh rate and a first scan time, a second operating mode having the first refresh rate and a second scan time, and a third operating mode having a second refresh rate and the second scan time;

displaying an image by using a display panel operatively connected with the processor;

receiving a user input onto the display panel;

identifying the operating mode corresponding to the received user input; and displaying another image associated with the image, based on the identified operating mode.

20. The non-transitory storage medium of claim 19, wherein the identifying of the operating mode comprises:

identifying an application, which is running, based on the user input; and determining the operating mode, based on a type of the identified application.

* * * * *